US009310160B1

(12) United States Patent
DiChario

(10) Patent No.: US 9,310,160 B1
(45) Date of Patent: Apr. 12, 2016

(54) HYBRID METAL/POLYMER PISTOL FRAME

(71) Applicant: American Tactical Imports, Inc., Rochester, NY (US)

(72) Inventor: Anthony DiChario, Pittsford, NY (US)

(73) Assignee: American Tactical Imports, Inc., Rochester, NY (US)

( * ) Notice: Subject to any disclaimer, the term of this patent is extended or adjusted under 35 U.S.C. 154(b) by 0 days.

(21) Appl. No.: 14/536,150

(22) Filed: Nov. 7, 2014

(51) Int. Cl.
*F41C 23/10* (2006.01)
*F41A 35/00* (2006.01)

(52) U.S. Cl.
CPC ..... *F41C 23/10* (2013.01); *F41A 35/00* (2013.01)

(58) Field of Classification Search
CPC ..... F41C 23/10; F41C 23/16; F41C 23/18; F41A 35/00
USPC ..... 89/1.4, 1.42; 42/72, 71.02
See application file for complete search history.

(56) References Cited

U.S. PATENT DOCUMENTS

| | | | | |
|---|---|---|---|---|
| 6,993,864 | B1 * | 2/2006 | O'Clair et al. | 42/75.02 |
| 2008/0060247 | A1 * | 3/2008 | Thomele et al. | 42/71.02 |
| 2013/0036644 | A1 * | 2/2013 | Bardy | 42/69.03 |

* cited by examiner

*Primary Examiner* — Stephen M Johnson
(74) *Attorney, Agent, or Firm* — Woods Oviatt Gilman LLP; Katherine H. McGuire, Esq.

(57) ABSTRACT

A combination metal/polymer frame is used with a pistol where the frame comprises a polymeric frame housing defining a barrel receiving portion and a stock portion. A metal stock insert is secured within the polymeric frame housing and is configured to mount a pistol fire control group on the frame. Additionally or alternatively, a metal frame insert is configured to removably reside within the polymeric frame housing. The metal frame insert defines an opening through which a round is communicated from a pistol magazine to a pistol chamber.

16 Claims, 7 Drawing Sheets

HYBRID METAL/POLYMER PISTOL FRAME

FIELD OF THE INVENTION

The present invention relates to pistols, and more particularly, to a hybrid pistol frame comprising a polymer frame member with integrated metal inserts. Specifically, the present invention relates to a hybrid pistol frame for use with an M1911 pistol. A metal stock insert may be configured to reside within the stock portion of the pistol frame so as to provide structural reinforcement to the pistol stock. A metal frame insert may be configured to receive a cartridge (or round) from the magazine and communicate such cartridge to the barrel for firing. The metal frame insert may further be configured so as to be interchangeable, thereby permitting the pistol to fire rounds of differing caliber depending upon the shooter's preference.

BACKGROUND OF THE INVENTION

There are a number of automatic and semi-automatic pistols used by military personnel as well as law enforcement and civilians. Due to its early adoption by the United States military and its prolonged service life within the armed force spanning nearly a century, arguably the most popular pistol in use, particularly within the United States, is the M1911 (and its later updated version designated M1911A1) and its clones, generally "the M1911 pistol." The M1911 pistol is a recoil-operated semi-automatic pistol firing from a closed breech. The pistol is magazine-fed and is typically chambered for the .45 Automatic Colt Pistol (ACP) cartridge wherein each magazine generally holds 7 to 8 rounds (bullets). While typically configured to fire .45 caliber rounds, dedicated versions of the M1911 may be modified to fire 9 mm rounds.

In operation, a full magazine is inserted in the stock portion of the pistol's frame. With a round in the chamber, a shooter pulls the trigger which disengages the sear from the hammer. The hammer is then pivoted forward due to force applied via the main spring. The hammered then propels the firing pin forward whereby the firing pin ignites the cartridge primer which causes the powder inside the cartridge to ignite. The burning powder evolves high pressure gases which propels the bullet down the barrel and ultimately out the muzzle. The expanding gases simultaneously push the cartridge case and the locked slide and barrel rearward. As the bullet exits the muzzle of the barrel, the pressure inside the barrel is diminished. Also at about this time, the barrel has completed its rearward travel and, due to the action of the barrel link, is pulled downward such that the barrel disengages from the slide. The slide, however, continues to travel rearward pulling the spent cartridge case with it. The cartridge case then strikes the ejector whereby the cartridge case is ejected from the chamber. As the slide continues its rearward movement, it recocks the hammer thereby preparing the pistol for the next firing sequence. To prevent the pistol from operating as a fully automatic pistol, the disconnector is also pushed down by the slide such that the disconnector prevents the hammer from coming forward again as the slide starts its forward movement under the force of the recoil spring. As the slide returns forward, it strips a new round from the magazine and pushes the round into the barrel's chamber. After the cartridge is fully inserted in the chamber, the slide reengages the barrel and pushes the barrel forward. Due to the barrel link, the barrel moves upwards until the barrel's slots engage the slide and lock the barrel and slide together. At this point, the pistol is ready to be fired again.

While the components comprising the M1911 may be constructed of a metal such as steel or aircraft grade forged aluminum, a trend in manufacturing current firearms/firearm components is to interchange metal parts/components with high strength polymeric materials, such as glass reinforced nylon, whenever possible. These polymeric parts/components decrease the weight of the firearm while also decreasing material costs associated with fabrication of the pistol or individual parts. One drawback in polymeric components, however, is the eventual wear of these components after repeated dismantling, cleaning and reassembly. Any substantial wear to any of the components may result in an unsafe and unusable firearm. A further drawback to polymeric pistol frames is the potential for fatigue or cracking of the frame, such as from the repetitive movements of the operative mechanics or should the pistol be dropped. In a worst case scenario, malfunctioning of the pistol may allow the firing pin to strike the cartridge primer of a chambered round, thereby firing the bullet without pulling of the trigger.

As such, there is a need for a pistol frame assembly which capitalizes upon the weight and cost savings afforded by polymeric materials while also enjoying the mechanical and structural strength afforded by metal (i.e., steel or aircraft grade aluminum). The present invention addresses these and other needs.

BRIEF SUMMARY OF THE INVENTION

In general, one aspect of the present invention is directed to a pistol frame constructed as a metal/polymer hybrid wherein the bulk of the frame is constructed of molded polymeric materials with at least a portion of the frame's stock constructed of a metal. A second metal insert may be removably secured to the polymeric frame material as described in more detail below.

A metal stock insert may be located within the stock portion of the frame and may be configured to be secured within the polymeric portion of the frame such that the constructed hybrid frame is a single, contiguous construction. The metal stock insert may be configured to engage at least the fire control group of the pistol and the associated pins used to secure the fire control group components within the frame. As used herein, the fire control group generally consists of the hammer, sear, disconnector and associated pins. The metal stock insert may further include a grooved platform extending above the body of the frame wherein the platform is configured to slidably engage the slide when the pistol is fired. In a further embodiment, the metal stock insert further extends the length of the stock so as to slidably engage the slide at one end and engage and secure the main spring housing to the stock at the other end.

A metal frame insert may be configured to removably reside within the frame. The metal frame insert may include an opening proportioned so as to communicate a round from the magazine through the opening of the metal frame insert and into the barrel. To that end, the metal frame insert may include a beveled feed ramp to facilitate chambering of the round. The metal frame insert may further include a barrel link portion configured to pivotally secure the barrel to the frame via a barrel link pin as is known in the art. The metal frame insert may also include a grooved platform adapted to slidably engage the slide when the pistol is fired.

In a further aspect of the present invention, the pistol may be selectively modified to chamber and fire rounds having a shooter-selected caliber. To that end, a first metal frame insert, along with the barrel, slide, extractor, and magazine configured to chamber and fire a round of a first caliber, e.g., .45 caliber ACP having a nominal bullet diameter of 11.43 mm, may be swapped so that the pistol may be built out with a second metal frame insert, barrel, slide, extractor and magazine configured to chamber and fire a round of a second caliber, e.g. 9 mm. All other components of the pistol, i.e., the frame, main spring components, fire control group, etc. need not be changed.

Accordingly, one embodiment of the present invention includes a combination metal/polymer frame for use with a pistol. The frame is adapted to carry a barrel and slide; a fire control group including a hammer, sear and disconnector; and a main spring housing. The frame is comprised of a polymeric frame housing defining a barrel receiving portion, a trigger guard and a stock portion. A metal stock insert is secured within at least a portion of the stock portion of the polymeric frame housing and is configured to mount the fire control group on the frame. The metal stock insert may further include an integral upwardly extending platform that has a groove configured to slidably engage mating rails on the slide.

The metal stock insert may further include a stock extension portion secured within the stock portion of the polymeric frame housing. The stock extension portion may be configured to slidably mount the main spring housing to the pistol stock. The stock extension portion may be further configured to accept a main spring housing pin to secure the main spring housing to the combination metal/polymer frame.

In a further embodiment, the metal stock insert further includes an elevated plate wherein the elevated plate is disposed within a plate opening on the polymeric frame housing. The elevated plate displays component identifiers, such as through casting or engraving, in compliance with applicable state, federal and/or international laws and regulations.

In still a further embodiment, the metal stock insert further includes at least one pair of opposing stock bushing lobes. Each stock bushing lobe is configured to engage a respective stock bushing and associated screw so as to secure a stock member (also commonly referred to as a grip) to the metal stock insert and thereby cover the stock portion of the polymeric frame housing. In one embodiment, the metal stock insert includes an upper pair of opposing stock bushing lobes and a lower pair of opposing stock bushing lobes. A first bushing lobe of each of the upper pair and lower pair of stock bushing lobes may be located on a right side of the metal stock insert and may be configured to engage a respective stock bushing and associated screw to secure a first stock member to the right side of the metal stock insert to cover the right side of the stock portion of the polymeric frame housing. A second bushing lobe of each of the upper pair and lower pair of stock bushing lobes may be located on a left side of the metal stock insert and may be configured to engage a respective stock bushing and associated screw to secure a second stock member to the left side of the metal stock insert to cover the left side of the stock portion of the polymeric frame housing.

In yet a further aspect of the present invention, the combination metal/polymer frame may additionally or alternatively further include a metal frame insert configured to removably reside within the polymeric frame housing. The metal frame insert defines an opening through which a round is communicated from a pistol magazine to a pistol chamber. The metal frame insert may also include a beveled feed ramp proportioned to assist chambering the round. The metal frame insert may further include a barrel link receiving portion adapted to receive a barrel link pin to thereby pivotally mount a barrel link to the frame.

In still a further aspect of the present invention, a method of modifying a pistol to fire rounds of differing caliber is provided. The method comprises the steps of a) providing a pistol with a combination metal/polymer frame wherein the frame comprises a polymeric frame housing defining a barrel receiving portion and a stock portion; and wherein a first metal frame insert is mounted within the polymeric frame housing with the first metal frame insert defining an first opening through which a round having a first caliber is communicated from a first pistol magazine to a first pistol chamber; b) removing the first metal frame insert from the polymeric frame housing; and c) mounting a second metal frame insert within the polymeric frame housing wherein the second metal frame insert defines a second opening through which a round having a second caliber is communicated from a second pistol magazine to a second pistol chamber.

The embodiments of the present invention are well-suited to reduce material costs while also maintaining structural integrity of the frame even after multiple firings and cleanings of the pistol or when the pistol has been subjected to severe or repeated drops. Further embodiments of the present invention permit interchangeability of the pistol's magazine and barrel thereby enabling the pistol to fire rounds of differing calibers. While the below description and associated drawings are directed to an exemplary M1911 pistol, those skilled in the art should readily understand that the teachings of the present invention may be extended for use with any suitable firearm and that such additional and alternative firearms are to be considered within the scope of the present invention.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
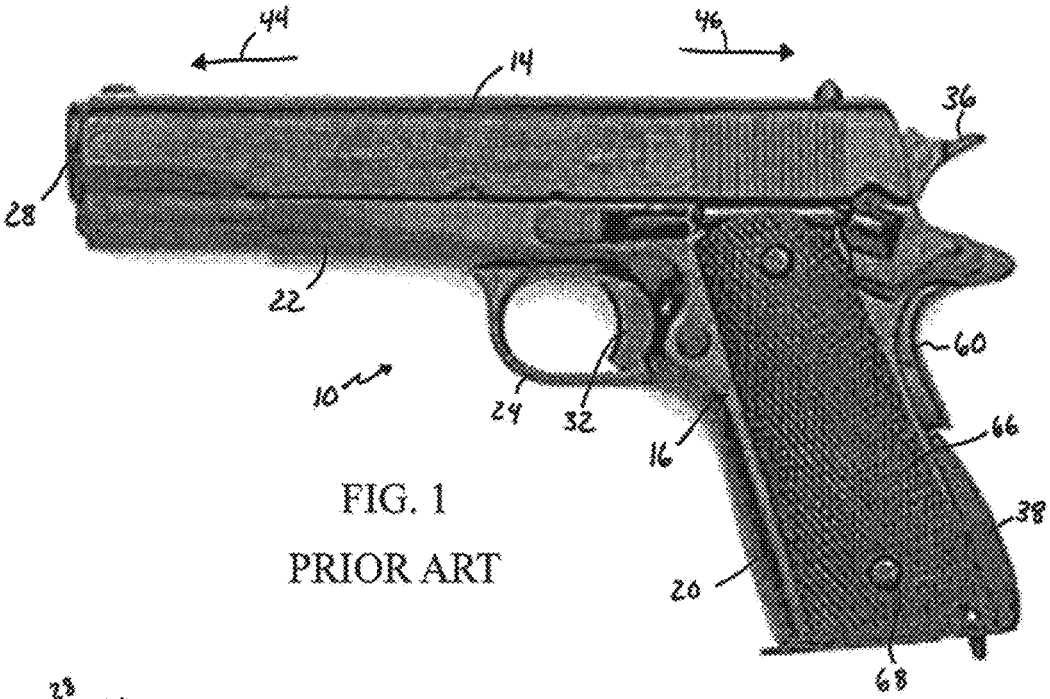
FIG. 1 PRIOR ART
FIG. 1 is a side view of a representative pistol, such as an M1911, suitable for incorporating an embodiment of a hybrid metal/polymer frame in accordance with present invention.
Figure 2:
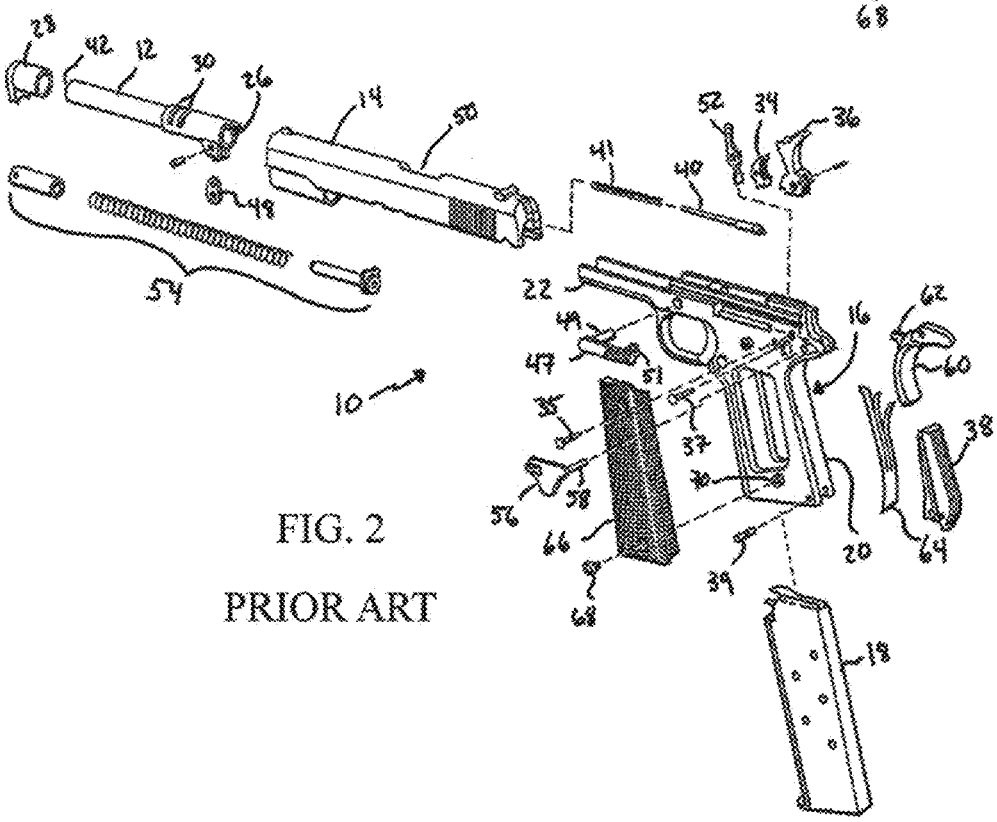
FIG. 2 PRIOR ART
FIG. 2 is an exploded view of a representative M1911 pistol.
Figure 3:
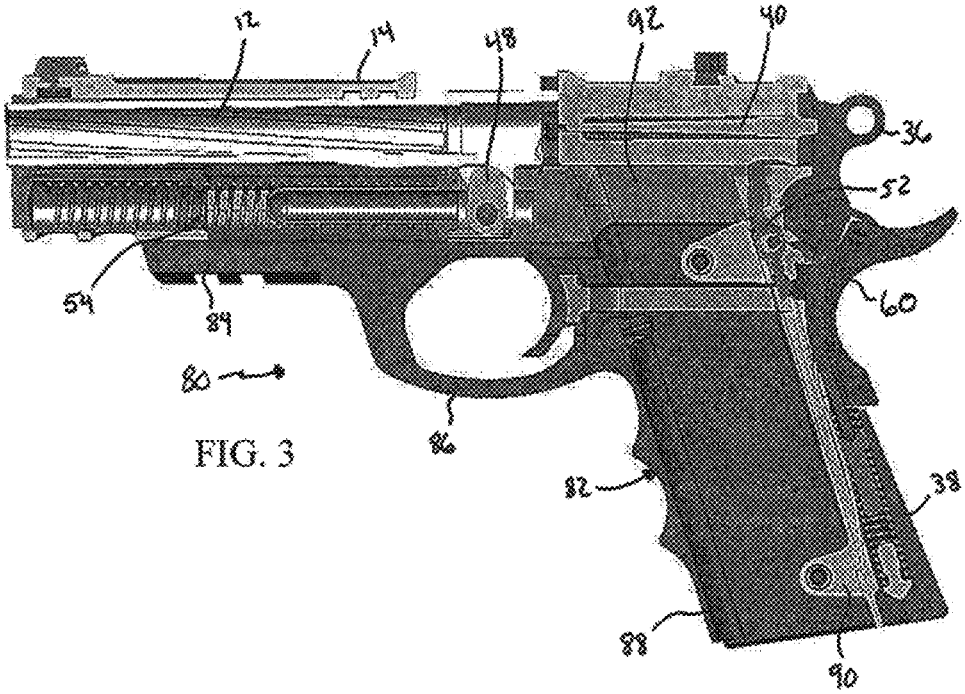
FIG. 3 is a cross sectional view of a pistol having a hybrid metal/polymer frame in accordance with an embodiment of the present invention.
Figure 4:
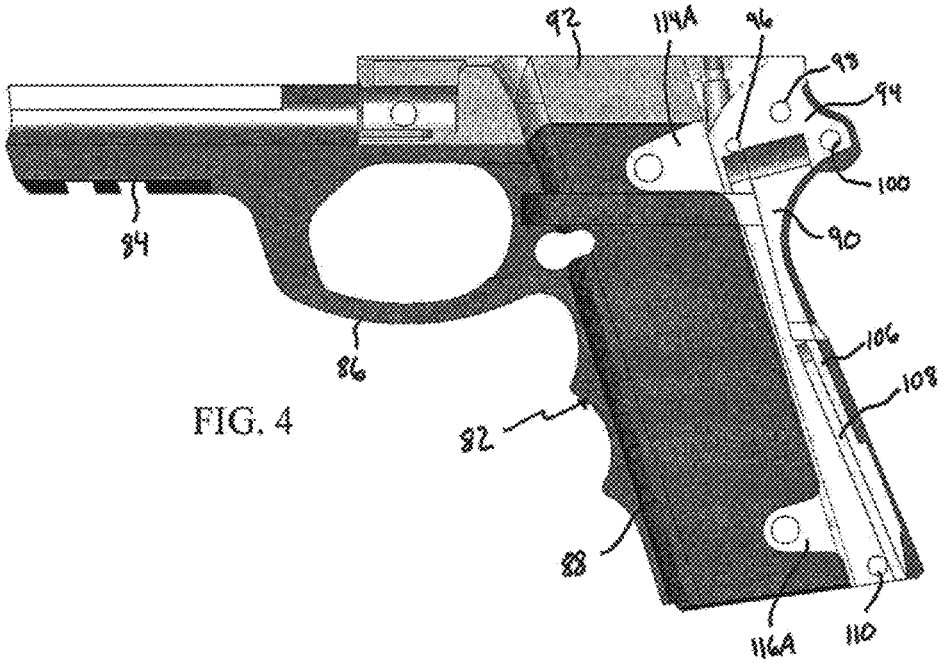
FIG. 4 is a cross sectional view of the hybrid metal/polymer frame shown in FIG. 3 taken generally along line 4-4 in FIG. 5.
Figure 5:
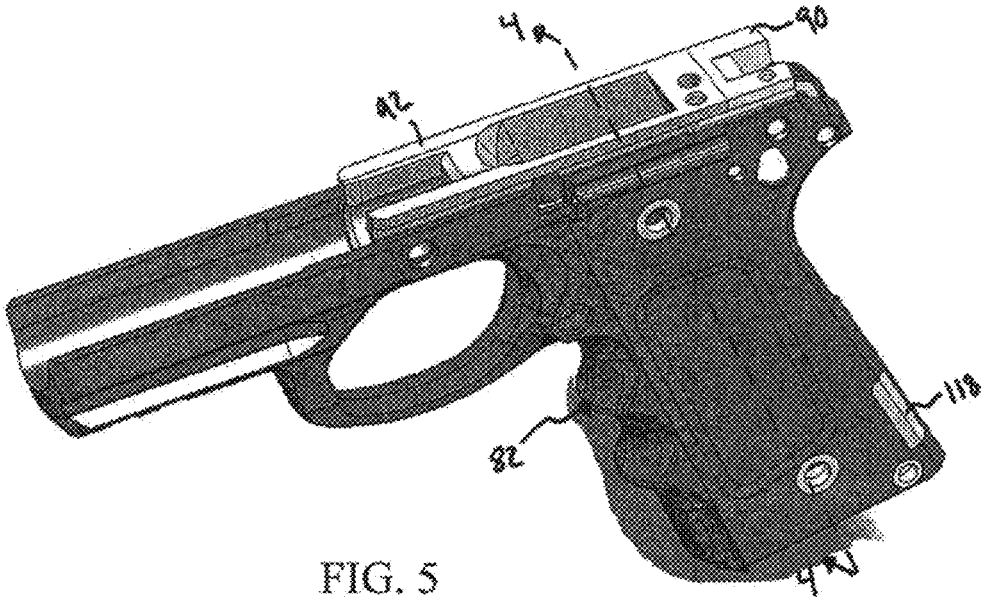
FIG. 5 is a side perspective view of the hybrid metal/polymer frame shown in FIGS. 3 and 4.
Figure 6:
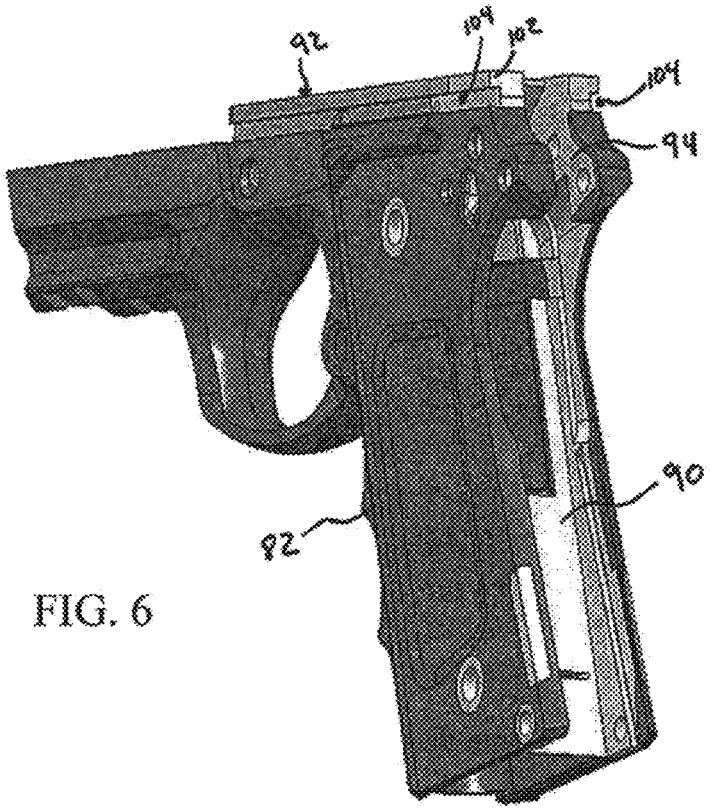
FIG. 6 is a rear perspective view of the hybrid metal/polymer frame shown in FIGS. 3 and 4.

Referring to the drawings in detail, and specifically to FIGS. 1 and 2, a pistol, such as the M1911, is generally indicated by reference numeral 10. Pistol 10 consists of a number of components and subcomponents. Major components of pistol 10 include barrel 12, slide 14, frame (also referred to as a receiver) 16 and magazine 18. Barrel 12 may be any desired length, such as the standard 5 inch length, but may be also be shorter, such as 4.5 inches, 4 inches or even 3 inches. Frame 16 is generally comprised of a stock portion 20, a barrel receiving portion 22 and trigger guard 24. When pistol 10 is assembled, a magazine 18 (filled with one or more rounds) is inserted in the stock portion of frame 16. A single round is then fed into chamber 26 of barrel 12. Barrel 12 is coupled to slide 14 via barrel bushing 28. When slide 14 is in its forward position, such as that shown in FIG. 1, barrel slots 30 on barrel 12 mate with and engage corresponding tabs within slide 14 (not shown) so as to lock the barrel with the slide.

To fire the pistol, a shooter pulls trigger 32 causing sear 34 to rotate about sear pivot pin 35 to disengage from hammer 36. Hammer 36 then pivots forward about hammer pin 37 due to a force applied via a main spring (not shown) residing within main spring housing 38. Main spring housing 38 is secured to stock portion 20 via a main spring housing pin 39. Hammer 36 then propels firing pin 40 forward against the force of firing pin spring 41 whereby the firing pin ignites the cartridge primer which causes the powder inside the cartridge to ignite. The burning powder evolves high pressure gases which propels the bullet down barrel 12 and ultimately out muzzle 42, as generally indicated by arrow 44. The expanding gases simultaneously push the cartridge case and the locked slide and barrel rearwardly (i.e., opposite muzzle 42 of barrel 12) as generally indicated by arrow 46. As the bullet exits the muzzle of the barrel, the pressure inside the barrel is diminished. Rearward travel of barrel 12 is limited due to barrel link 48 which pivots to cause barrel 12 to slide downwardly and disengage from slide 14. Slide 14 continues its rearward movement such that the spent cartridge is ejected out breech 50. As the slide continues its rearward movement, it recocks hammer 36 thereby preparing the pistol for the next firing sequence.

To prevent pistol 10 from operating as a fully automatic pistol, disconnector 52 is pushed downward by the rearward travel of slider 14. Together, sear 34, hammer 36 and disconnector 52 may be referred to as a fire control group. In this manner, disconnector 52 prevents hammer 36 from coming forward again as slide 14 starts its forward movement under the force of compressed recoil spring assembly 54. As slide 14 returns to its forward position (FIG. 1), it strips a new round from magazine 18 and pushes the round into chamber 26 of barrel 12. After the cartridge is fully inserted in chamber 26, slide 14 reengages barrel 12 thereby pushing barrel 12 forward. Under action of barrel link 48, barrel 12 moves upwards until barrel slots 30 engage with their respective tabs within slide 14, thereby locking barrel 12 and slide 14 together. At this point, pistol 10 is ready to be fired again. After firing the last round in magazine 18, or through manual actuation, slide stop 47 locks slide 14 in its rearward position. Slide stop 47 is pivotally actuated about slide stop pin 49 by the follower (not shown) within the emptied magazine impacting slide stop post 51 such that slide stop pin 49 and slide stop post 51 operate to secure slide 14 to frame 16. Barrel link 48 is also pivotally mounted to slide stop pin 49 so as to enable the rearward and downward movement of the barrel as the slide moves rearwardly immediately after firing a round.

The M1911, such as that shown in FIGS. 1 and 2, includes numerous safety features to prevent unwanted discharge of the pistol. Safety lock 56 (also known as a thumb safety) may be pivoted upwardly via safety pin 58 such that movement of sear 34 is prevented. Safety lock 56 may be located on either or both of the left side or right side of the stock to accommodate the preferred handedness of the shooter. Pistol 10 may also include grip safety 60 having a grip safety arm 62. When pistol 10 is in its resting state, grip safety arm 62 contacts trigger 32 and prevents movement of trigger 32 until grip safety 60 is depressed by the web of the shooter's hand as he or she grasps the pistol stock. Once the pistol is grasped, grip safety 60 pivots about safety pin 58 thereby disengaging grip safety arm 62 from trigger 32 such that trigger 32 can then be pulled to initiate firing of the pistol as discussed above.

To maintain the above safety features in their proper resting positions, pistol 10 may include a sear spring 64. Sear spring 64 is housed within the stock portion 20 of pistol 10 and is held in place via main spring housing 38. Sear spring 64 is typically a three-prong flat spring wherein one prong of the spring pushes trigger 32 forward (i.e. in the direction of arrow 44), a second prong pushes sear 34 so as to maintain sear 34 contact with hammer 36, and a third prong which pushes grip safety 60 backward (i.e. in the direction of arrow 46) so as to keep grip safety arm 62 in contact with trigger 32 when the pistol is not gripped by the shooter.

Covering each side of stock portion 20 is a respective stock member 66 (for simplicity, only one stock member is shown in FIG. 2). Stock member 66 (also commonly referred to as a grip) is customizable so that each shooter can create a pistol grip which provides the desired aesthetics and degrees of comfort and gripability. Stock member 66 is secured to stock portion 20 via stock member screw 68 threaded into a stock bushing 70.

Turning now to FIGS. 3 through 12, a hybrid metal/polymer pistol, such as the M1911 pistol, is generally indicated by reference numeral 80. As can be seen most clearly in FIGS. 4-6, hybrid metal/polymer pistol 80 includes a polymeric frame housing 82 defining a barrel receiving portion 84, a trigger guard 86 and a stock portion 88 similar to frame 16 described above. Secured within at least a portion of polymeric frame housing 82 may be metal stock insert 90. Metal stock insert 90 may provide structural support and rigidity to the frame portion of metal/polymer pistol 80. A metal frame insert 92 may be removably mounted within frame housing 82. The remainder of hybrid metal/polymer pistol 80 is comprised of standard pistol components, i.e. barrel 12, slide 14, grip safety 60, main spring housing 38, hammer 36, barrel link 48, recoil spring assembly 54, etc. In accordance with an aspect of the present invention, these standard components, where appropriate, are engineered in accordance with military specifications (are mil-spec parts).

Figure 9:
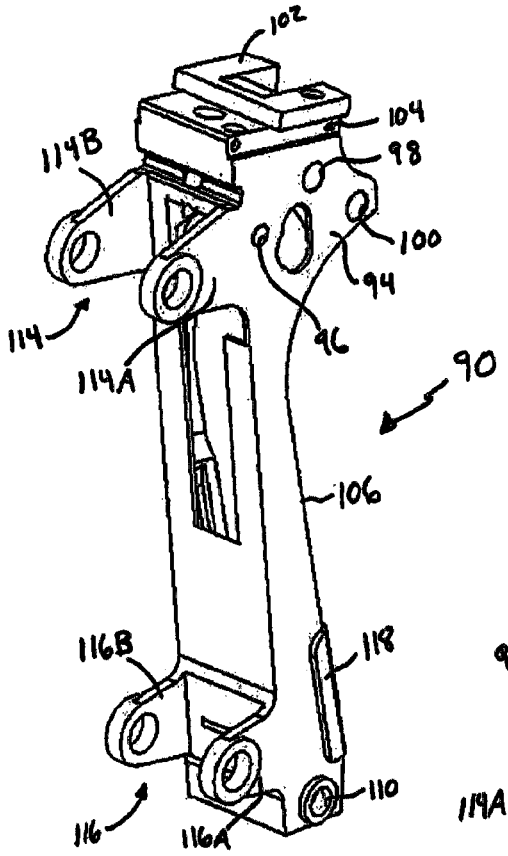
FIG. 9 is a front side perspective view of a metal stock insert of the hybrid metal/polymer frame shown in FIGS. 3-6.
Figure 10:
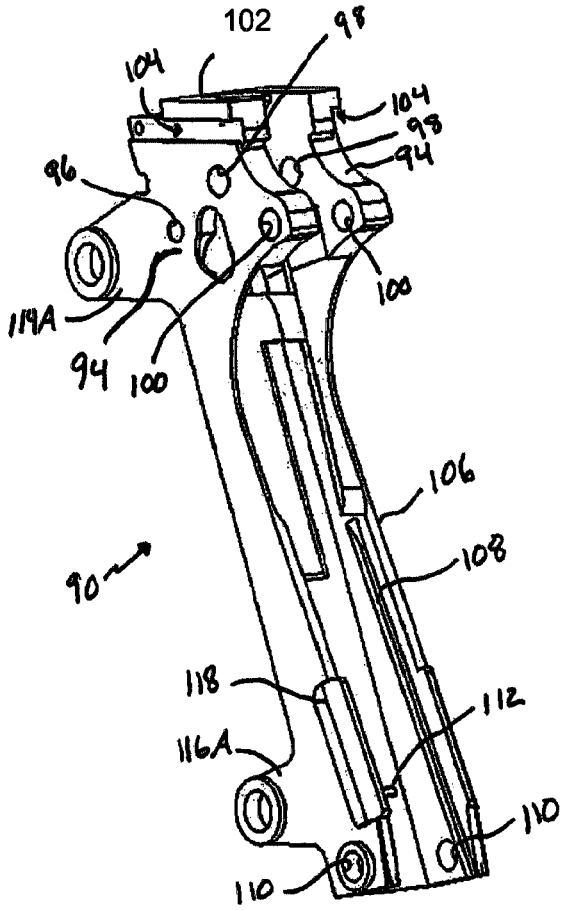
FIG. 10 is a rear side perspective view of a metal stock insert of the hybrid metal/polymer frame shown in FIGS. 3-6.

With continued reference to FIGS. 3-6, and more particularly to FIGS. 9 and 10, in one aspect of the present invention, metal stock insert 90 includes a fire control group portion 94 that is configured to reside within polymeric frame housing 82. Fire control group portion 94 defines sear pin hole 96, hammer pin hole 98 and safety pin hole 100 arranged and proportioned to pivotally seat the sear pin, hammer pin and safety pin (i.e., sear pin 35, hammer pin 37 and safety pin 58 as seen and described above with regard to FIG. 2) within their respective holes 96, 98, 100. In a further aspect of the present invention, fire control group portion 94 is configured to receive M1911 fire control group components which meet military specifications (i.e., mil spec parts). As the pins and fire control group portion are all fabricated from a durable metal, wear due to the various forces experienced by these components during repetitive firing and subsequent cleaning of the pistol as described above is reduced. Present frames constructed exclusively of polymeric material may experience ovaling or cracking of the pin holes due to such stresses.

In a further aspect of the present invention, metal stock insert 90 includes an integral upwardly extending platform 102 which extends above the horizontal plane created by barrel receiving portion 84 of polymeric frame housing 82. Platform 102 may include a pair of grooves 104 configured to engage with a slide (i.e., slide 14) to facilitate the rearward and forward translation of the slide during firing and reloading of the pistol. Similar to the benefits of fire control group portion 94 discussed above, metal platform 102 resists the wear and tear experienced from the reciprocal sliding action of slide 14 during repeated and prolonged use of the pistol. Frames fabricated solely of polymeric materials may wear or crack due to this repetitive movement of the slide.

In a still further aspect of the present invention, metal stock insert 90 may be extended to include a stock extension portion 106 such that metal stock insert 90 substantially traverses the length of polymer stock portion 88. Stock extension portion 106 may include opposing channels 108 which are configured to slidably engage opposing ridges on a main spring housing, such as main spring housing 38 shown in FIG. 2. Stock extension portion 106 may also include a main spring housing pin hole 110 configured to accept a main spring housing pin (i.e., pin 39) so as to secure the main spring housing (38) to frame 82. Stock extension portion 106 may further include a sear spring slot 112 configured to mount a sear spring (i.e., sear spring 64) within the stock portion of the pistol as described above. Again, the metal stock extension portion 106 may more readily resist wear and distortion due to repeated removal and replacement of main spring housing pin 39 and the sliding of the main spring housing within channels 108, as well as the spring action and associated forces generated by sear spring 64.

In yet a further aspect of the present invention, metal stock insert 90 may include an upper pair of opposing stock bushing lobes 114 and a lower pair of opposing stock bushing lobes 116. A first bushing lobe 114A/116A of each of the upper pair and lower pair of stock bushing lobes, respectively, is located on a right side of the metal stock insert and is configured to engage a respective stock bushing (such as stock bushing 70) and associated screw (stock screw 68) to secure a first stock member (stock member 66) to the right side of metal stock insert 90 thereby covering the right side of the stock portion 88 of the polymeric frame housing 82. A second bushing lobe 114B/116B of each of the upper pair and lower pair of stock bushing lobes, respectively, is located on a left side of metal stock insert 90 and is configured to engage a respective stock bushing (stock bushing 70) and associated screw (stock screw 68) to secure a second stock member to the left side of metal stock insert 90 thereby covering a left side of the stock portion 88 of the polymeric frame housing 82. Again, the metal material of metal stock insert 90 resists wear and ovaling due to removal and replacement of the stock bushings and stock screws, as well as that due to the torque experienced by the stock members when the pistol is withdrawn from a holster and gripped by a shooter.

Figure 7:
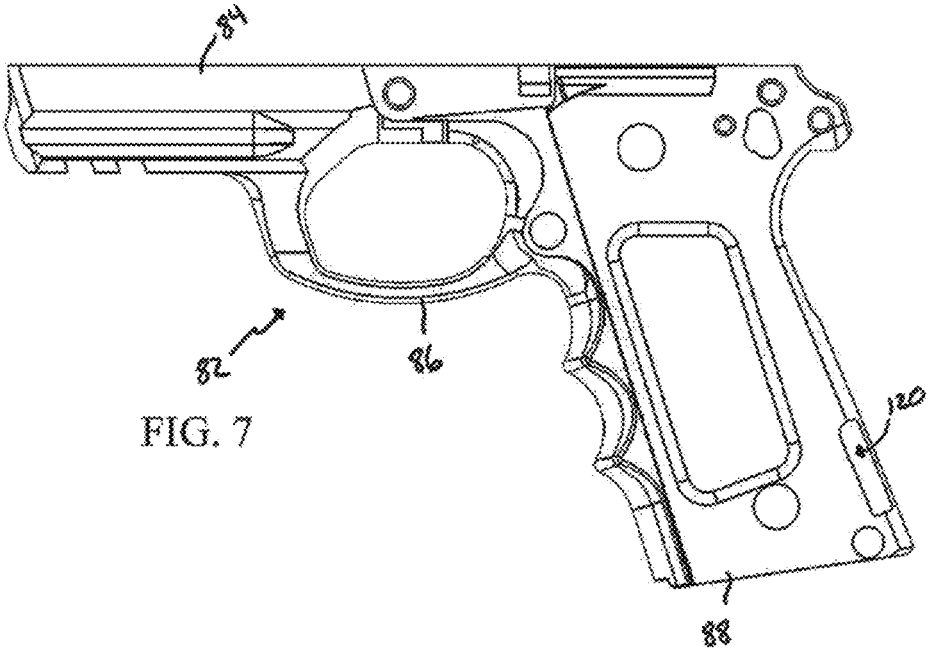
FIG. 7 is a side view of a polymeric frame housing of the hybrid metal/polymer frame shown in FIGS. 3-6.
Figure 8:
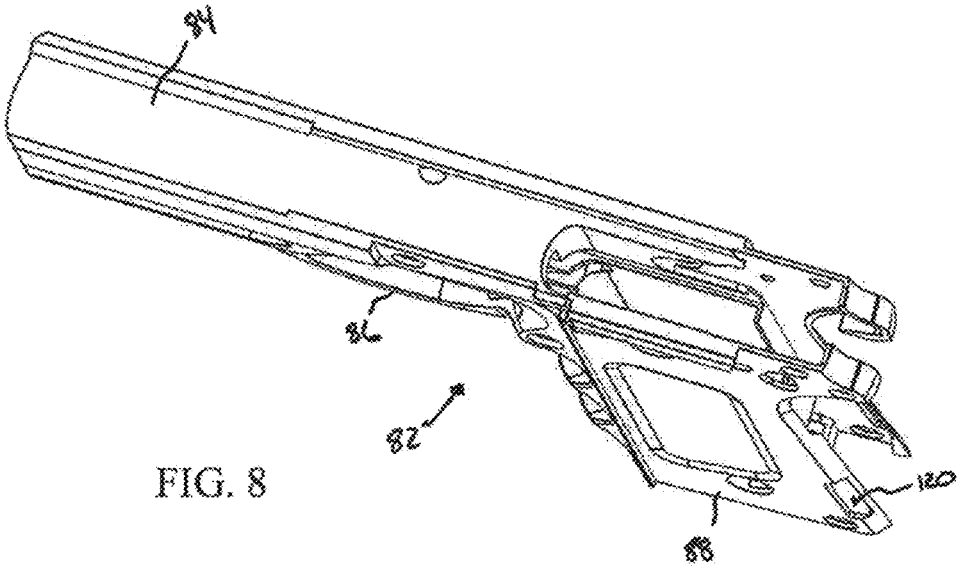
FIG. 8 is a top perspective view of a polymeric frame housing of the hybrid metal/polymer frame shown in FIGS. 3-6.

In a further aspect of the present invention, metal stock insert 90 may further include an elevated plate 118 disposed within a plate opening 120 defined by polymeric frame housing 82 (see FIGS. 7 and 8). Elevated plate 118 may allow for the marking of a serial number or other identifier upon frame housing 82 in compliance with 27 C.F.R. §479.102. Elevated plate 118 may be conspicuously placed on the frame and, by being incorporated within the first metal insert, is not susceptible to being readily obliterated, altered or removed. The size, position and/or orientation of the elevated plate can be modified as desired or necessitated so as to enable marking of the frame in satisfaction of any state, federal or international law or regulation.

Figure 11:
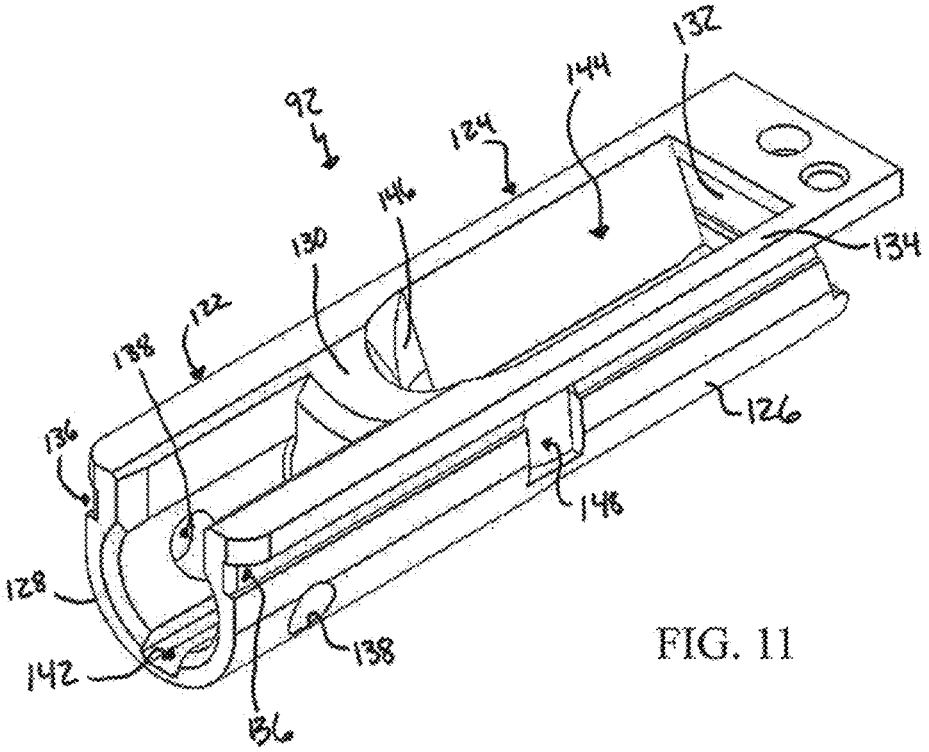
FIG. 11 is a front side perspective view of a metal frame insert of the hybrid metal/polymer frame shown in FIGS. 3-6.
Figure 12:
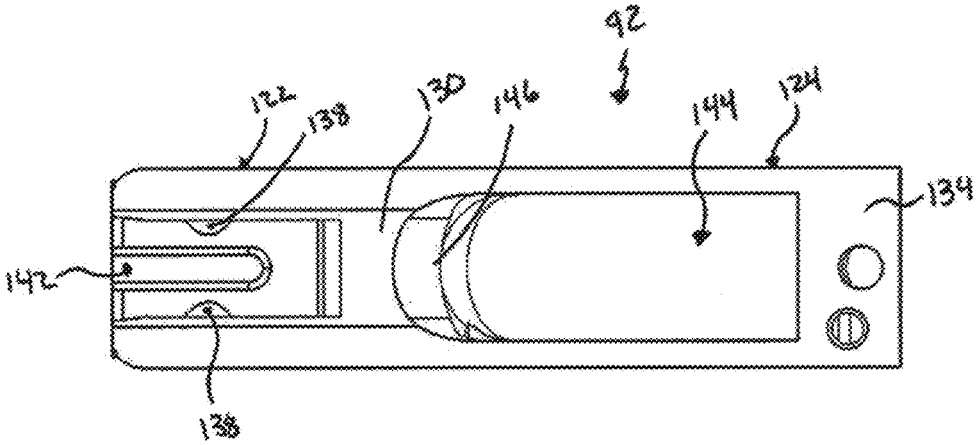
FIG. 12 is a rear side perspective view of a metal frame insert of the hybrid metal/polymer frame shown in FIGS. 3-6.

With reference to FIGS. 11 and 12, in a further aspect of the present invention, metal/polymer pistol 80 may further include a metal frame insert 92. Metal frame insert 92 may be configured to be removably nested within polymeric frame housing 82 wherein metal frame insert 92 at least partially bridges stock portion 88 and barrel portion 84 of housing 82. Metal frame insert 92 is generally comprised of a front portion 122 and rear portion 124 defined by insert sidewalls 126, 128. A shared inner wall 130 separates the front and rear portions 122, 124, with rear portion 124 further including a rear wall 132. The upper edges of sidewalls 126, 128 and rear wall 132 may be configured to form a platform 134 which extends above the horizontal plane created by barrel receiving portion 84 of polymeric frame housing 82. Platform 134 may define a pair of grooves 136 configured to engage with a slide (i.e., slide 14) to facilitate the rearward and forward translation of the slide during firing and reloading of the pistol. The metal platform 134 may resist the wear and tear experienced from the reciprocal sliding action of slide 14 during repeated and prolonged use of the pistol whereas frames fabricated solely of polymeric materials may wear or crack due to the repetitive movement of the slide.

Front portion 122 of metal frame insert 92 may be configured to reside generally within barrel portion 84 of frame housing 82. Each of sidewalls 126, 128 may further define a respective hole 138 which is adapted to receive slide stop pin 49. Bottom wall 140 may further include a channel 142 configured to accommodate barrel link 48 during the rotational travel of barrel link 48 as the slide and barrel reciprocally travel rearward and forward during operation of the pistol. The metal sidewalls 126, 128 and associated holes 138 reduce the wear and tendency to oval due to the repeated rotation of slide stop pin 49 and the jarring impacts to the frame generated by the forces necessary to disengage the barrel from the slide during recoil and subsequent discharge of the spent cartridge. Again, present frames constructed exclusively of polymeric material may experience ovaling or cracking due to such stresses.

Rear portion 124 of metal frame insert 92 may be configured to reside within stock portion 88 of frame housing 82 so as to generally lie above magazine 18. Rear portion 124 defines an opening 144 through which a round is passed from magazine 18 to chamber 26 of barrel 12 upon reloading of the pistol following discharge of a spent cartridge as discussed above. Shared inner wall 130 may include an inclined surface or feed ramp 146 to facilitate direction of the fresh round into chamber 26. As feed ramp 146 is fabricated from a durable metal, wear due to the repetitive sliding of rounds from the magazine to the chamber during reloading of the pistol is reduced. Sidewall 126 may further include a cutout 148 which may be adapted to receive slide stop post 51 upon actuation of slide stop 47. In this manner, slide 14 will be locked in its rearward position due to the engagement of slide stop pin 49 in holes 138 and slide stop post 51 in cutout 148 such that barrel link 48 is unable to return pivot forward to reengage slide 14 with barrel 12 once slide stop 47 has been actuated (either manually or via the magazine follower).

Figure 13:
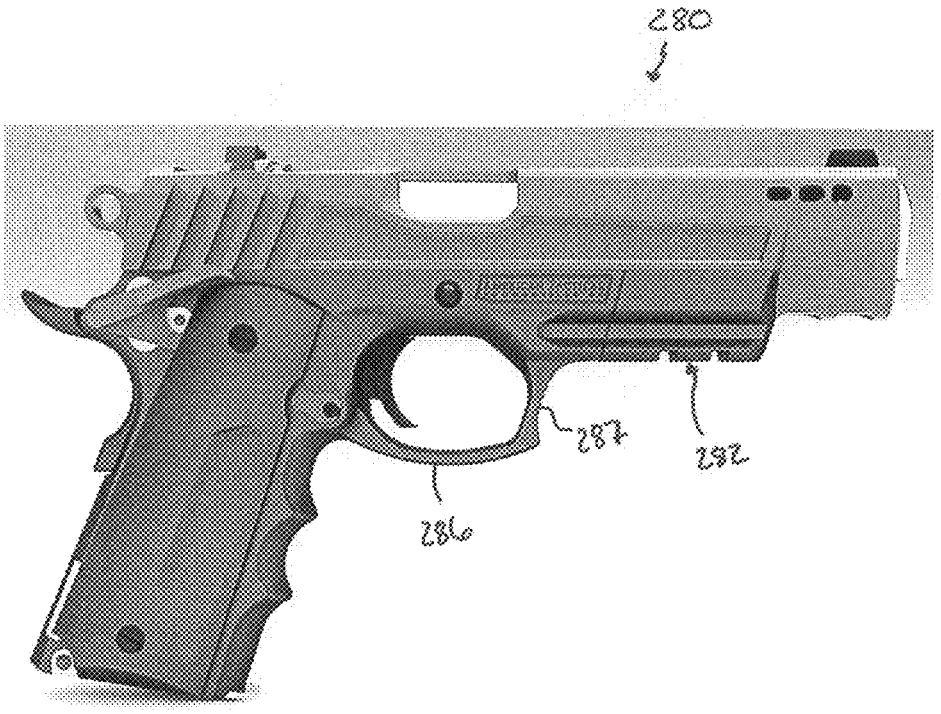
FIG. 13 is a side view of a pistol having a hybrid metal/polymer frame in accordance with an alternative embodiment of the present invention.

Turning now to FIG. 13, an alternative hybrid metal/polymer pistol is generally indicated by reference numeral 280. Hybrid metal/polymer pistol 280 is identical to hybrid metal/polymer pistol 80 is all respects except for modifications made to frame 282. Trigger guard 286 has been modified to more comfortably accommodate two-handed operation of pistol 280 by thinning and providing a slight curvature to front portion 287 of trigger guard 286 as opposed to trigger guard 86 of pistol 80.

In a further aspect of the present invention, hybrid metal/polymer pistol 80/280 is configured so as to enable modification of the pistol components so that the pistol may chamber and fire rounds of a shooter-selected caliber. By way of example, hybrid metal/polymer pistol 80/280 may be initially chambered to fire .45 ACP rounds. To that end, pistol 80/280 may initially include a first metal frame insert 92 having an opening 144 and feed ramp 146 proportioned to enable extraction of a .45 round from magazine 18 and chambering within chamber 26. Similarly, barrel 12, slide 14, cartridge extractor (not shown) and magazine 18 are each configured and proportioned for operation with .45 caliber rounds. To date, should the shooter wish to fire 9 mm rounds, said shooter would have to have a second pistol solely dedicated to firing 9 mm rounds.

However, in accordance with an aspect of the present invention, pistol 80/280 may be selectively modified to fire a second caliber round without requiring a completely dedicated second pistol. Pistol 80 need only be stripped to remove the barrel, slide and extractor. An alternative second metal frame insert proportioned to extract and chamber the second caliber round is then swapped with the first metal frame insert. A second barrel, slide and extractor are then mounted to the pistol where each of the second barrel, slide and extractor is also proportioned for the second caliber round. Finally, a magazine carrying the second caliber rounds is then loaded into the pistol and a round having the second caliber is chambered and ready to fire. All other components of pistol 80/280 need not be changed in order to fire the second caliber rounds. Examples of alternative caliber rounds include, without limitation thereto, 9 mm parabellum, .40 S&W, .357sig, and 10 mm rounds.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A combination metal/polymer frame for use with a pistol, the frame comprising:

a) a polymeric frame housing defining a barrel receiving portion and a stock portion; and b) a metal stock insert secured within the polymeric frame housing, the metal stock insert including:

i) a fire control group portion proportion to receive a pistol fire control group;

ii) an integral upwardly extending platform having a pair of grooves configured to slidably engage a pistol slide; and iii) a downwardly extending stock extension portion secured within the stock portion of the polymeric frame housing, the stock extension portion including one or more channels configured to slidably engage a pistol main spring housing.

2. The combination metal/polymer frame of claim 1 wherein said stock extension portion includes a pin hole configured to accept a main spring housing pin to secure the main spring housing to the combination metal/polymer frame.

3. The combination metal/polymer frame of claim 1 wherein said metal stock insert further includes at least one pair of opposing stock bushing lobes, each stock bushing lobe configured to engage a respective stock bushing and associated screw to secure a stock member to the metal stock insert and cover the stock portion of the polymeric frame housing.

4. The combination metal/polymer frame of claim 3 wherein said metal stock insert includes an upper pair of opposing stock bushing lobes and a lower pair of opposing stock bushing lobes, a first bushing lobe of each of the upper pair and lower pair of stock bushing lobes located on a right side of the metal stock insert and configured to engage a respective stock bushing and associated screw to secure a first stock member to the right side of the metal stock insert thereby covering a right side of the stock portion of the polymeric frame housing, and a second bushing lobe of each of the upper pair and lower pair of stock bushing lobes located on a left side of the metal stock insert and configured to engage a respective stock bushing and associated screw to secure a second stock member to the left side of the metal stock insert thereby covering a left side of the stock portion of the polymeric frame housing.

5. The combination metal/polymer frame of claim 1 wherein said metal stock insert further includes an elevated plate disposed within and projecting outwardly through a plate opening on said polymeric frame housing.

6. The combination metal/polymer frame of claim 5 wherein said elevated plate is marked with a serial number or other identifier.

7. The combination metal/polymer frame of claim 1 and further comprising:

c) a metal frame insert removably nested within the polymeric frame housing, the metal frame insert defining an opening through which a round is communicated from a pistol magazine to a pistol chamber.

8. The combination metal/polymer frame of claim 7 wherein the metal frame insert includes a beveled feed ramp proportioned to assist chambering the round.

9. The combination metal/polymer frame of claim 7 wherein the metal frame insert includes a front portion adapted to receive a barrel link pin to thereby pivotally mount a barrel link to the frame.

10. The combination metal/polymer frame of claim 9 wherein the front portion of the metal frame insert includes a channel configured to accommodate the barrel link.

11. A combination metal/polymer frame for use with a pistol capable of being selectively modified to chamber and fire rounds having differing calibers, the frame comprising:

a) a polymeric frame housing defining a barrel receiving portion and a stock portion;

b) a metal stock insert secured within the polymeric frame housing, the metal stock insert including:

i) a fire control group portion proportion to receive a pistol fire control group;

ii) an integral upwardly extending platform having a pair of grooves configured to slidably engage a pistol slide; and iii) a downwardly extending stock extension portion secured within the stock portion of the polymeric frame housing, the stock extension portion including one or more channels configured to slidably engage a pistol main spring housing; and c) a first metal frame insert removably nested within the polymeric frame housing, the first metal frame insert defining an opening through which a round having a first caliber is communicated from a first pistol magazine to a first pistol chamber, wherein, the pistol is modified by selectively removing the first metal frame insert from the polymeric frame housing and inserting a second metal frame insert having a second pistol chamber into the polymeric frame housing.

12. The combination metal/polymer frame of claim 11 wherein the first metal frame insert may be removed and the second metal frame insert may be inserted into the polymeric frame housing without requiring modification of the polymeric frame housing, the metal stock insert or the pistol fire control group.

13. The combination metal/polymer frame of claim 11 wherein said metal stock insert further includes an elevated plate disposed within and projecting outwardly through a plate opening on said polymeric frame housing.

14. The combination metal/polymer frame of claim 13 wherein said elevated plate is marked with a serial number or other identifier and wherein the first metal frame insert may be removed and the second metal frame insert may be inserted into the polymeric frame housing without requiring modification of the polymeric frame housing, the metal stock insert, the elevated plate or the pistol fire control group.

15. The combination metal/polymer frame of claim 14 wherein the elevated plate includes an identifier.

16. The combination metal/polymer frame of claim 15 wherein the identifier is serial number.

* * * * *